United States Patent [19]

Nakamura

[11] Patent Number: 5,064,072

[45] Date of Patent: Nov. 12, 1991

[54] PACKAGING CARTON

[75] Inventor: Masayuki Nakamura, Kanagawa, Japan

[73] Assignee: Fuji Photo Film Co., Ltd., Kanagawa, Japan

[21] Appl. No.: 547,358

[22] Filed: Jul. 3, 1990

[30] Foreign Application Priority Data

Jul. 3, 1989 [JP] Japan ..... 1-77623[U]

[51] Int. Cl.[5] ..... B65D 25/04; B65D 5/54

[52] U.S. Cl. ..... 229/120.03; 206/391; 206/622; 229/120.06; 229/120.27; 229/121; 229/232; 229/233

[58] Field of Search ..... 229/120.06, 120.24, 229/120.31, 120.27, 120.18, 120.03, 121; 206/614, 446, 391, 622, 625

[56] References Cited

U.S. PATENT DOCUMENTS

| | | | |
|---|---|---|---|
| 2,351,812 | 6/1944 | Guyer | 206/622 |
| 2,874,736 | 2/1959 | Huges | 229/120.03 |
| 2,955,736 | 10/1960 | Annen, Sr. | 229/120.03 |
| 3,157,344 | 11/1964 | Hennessey . | |
| 3,536,246 | 10/1970 | Rosen | 229/120.18 |
| 3,640,446 | 2/1972 | Grieve | 206/625 |
| 4,375,263 | 3/1983 | Dworkin | 229/120.07 |
| 4,398,636 | 8/1983 | Baxter . | |
| 4,398,661 | 8/1983 | Schillinger | 229/120.03 |
| 4,441,612 | 4/1984 | Kingsley et al. . | |
| 4,826,016 | 5/1989 | Foster | 229/120.03 |

FOREIGN PATENT DOCUMENTS

| | | | |
|---|---|---|---|
| 203889 | 12/1986 | European Pat. Off. . | |
| 3031663 | 3/1982 | Fed. Rep. of Germany | 229/120.03 |
| 0218051 | 5/1968 | U.S.S.R. | 229/120.24 |

*Primary Examiner*—Stephen Marcus
*Assistant Examiner*—Christopher McDonald
*Attorney, Agent, or Firm*—Sughrue, Mion, Zinn, Macpeak & Seas

[57] ABSTRACT

A packaging carton is provided with tear lines which define openings in alignment with a plurality of articles within the packaging carton so that individual articles can be removed from the packaging carton independently. Further, walls are provided between each article for positioning the article so that it is taken out only by opening the individual tear lines and the respective articles are prevented from moving within the carton.

7 Claims, 3 Drawing Sheets

PACKAGING CARTON

BACKGROUND OF THE INVENTION

The present invention relates to a packaging carton, and more particularly to a packaging carton capable of housing a plurality of containers each of which contains a magazine having photographic film built therein.

Conventionally, photographic films have been packaged by first accommodating a magazine having a rolled photographic film in a resin-made magazine container, and then accommodating each container in a packaging carton for sale (for example, See U.S. Pat. No. 4,441,612.) In recent years, with the increasing use of photographs, it is common to sell a plurality of film magazines in a single package. However, packaging a plurality of products which are each packed in a separate decorative box as a single package for sale suffers from several disadvantages, including the inefficient use of packaging materials, the requirement of extra stages in the packaging process, and the increased cost of the products. As a result, a packaging carton is widely used for packaging a plurality of containers, each of which contains a magazine therein.

In conventional packaging cartons in which a plurality of magazine containers are accommodated, the carton is opened by breaking an opening portion that is adapted to be opened wide. In the alternative, the magazines may be taken out without opening the carton wide, that is, they may be removed through one end of the carton. However, even if the plurality of magazines can be taken out one at a time from the packaging carton, there is generally no need to immediately use all the film taken out. The containers that accommodate magazines containing film which is not for immediate use are usually stored in the opened packaging carton or they are left out of the packaging carton. In the meantime, the exposed films are rewound and put back into the magazine container. However, the user cannot determine from the appearance of the magazines whether the films in the container are exposed films or unexposed films.

SUMMARY OF THE INVENTION

Thus, the present invention is to provide a packaging carton in which the exposed and unexposed magazines are not mixed up so that they can be distinguished, and to provide a packaging carton capable of accommodating a plurality of magazines.

The object mentioned above is achieved by a packaging carton for accommodating a plurality of articles. The carton is perforated to define portions through which respective articles are separately removed when the tear lines are broken to open the carton. Walls are provided to project into an inner space of the carton, and the walls are interposed between the respective articles to position the respective articles within the carton such that each of the articles is in alignment with a respective one of the portions.

DESCRIPTION OF THE DRAWING

An embodiment of the present invention will now be described in detail with respect to the accompanying drawings in which.

DETAILED DESCRIPTION OF THE PREFERRED EMBODIMENT

Figure 1:
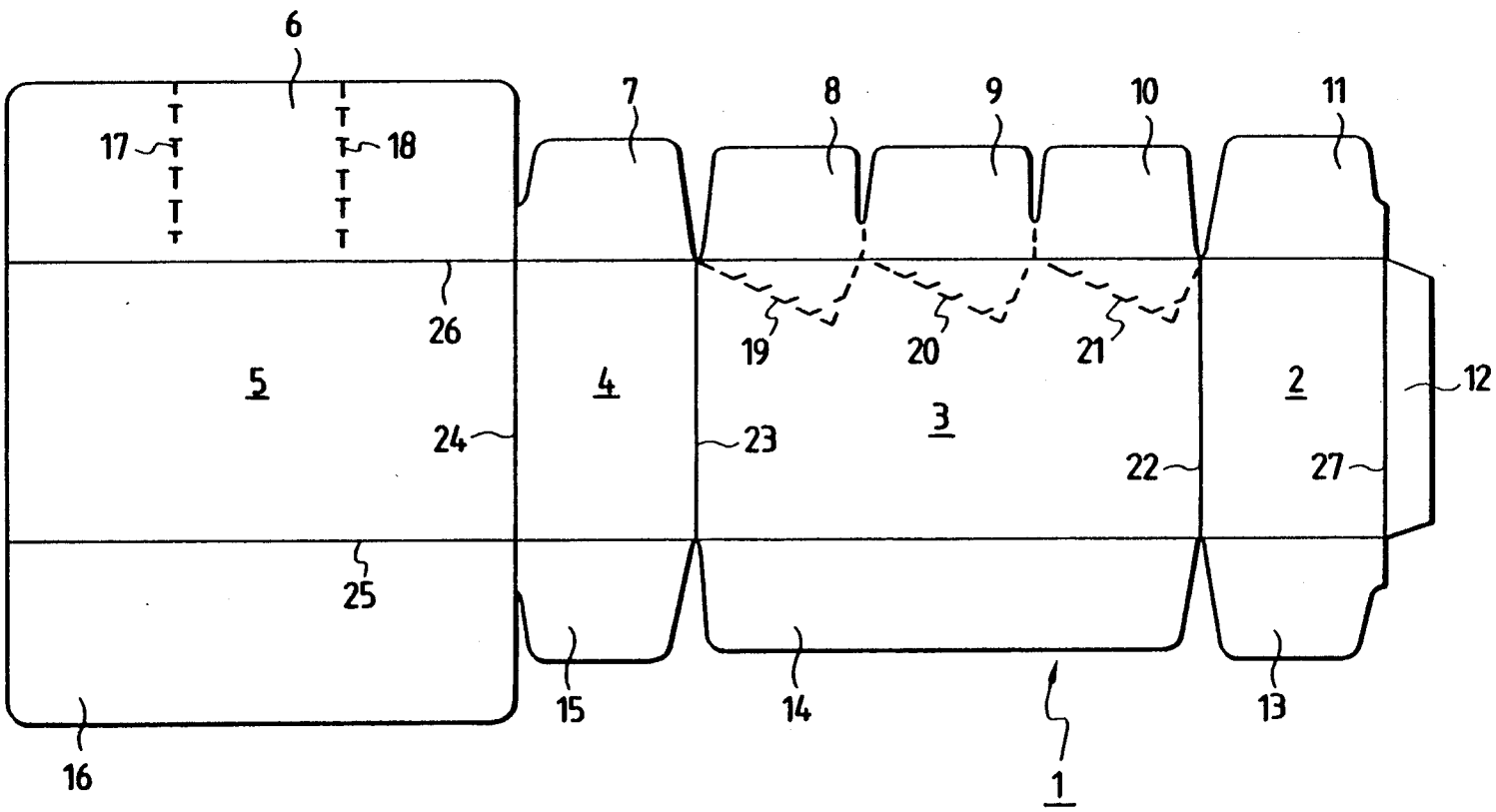
FIG. 1 is a plan view of an embodiment of a packaging carton, before it is assembled, according to the invention.

As shown in FIG. 1, an embodiment of a packaging carton 1 according to the invention is provided with a rear board 3, side boards 2 and 4 positioned on both sides of the rear board 3, and a front board 5 that is connected to the side board 4, around which sticking tabs 6, 8, 9, 10, 12, 14, and 16, and fold flaps 7, 11, 13 and 15 are formed. The respective boards are defined by fold lines 22, 23 and 24 between the respective boards, as well as by fold lines 25, 26, and 27 between the respective boards and the sticking tabs. The tab 6 is perforated at 17 and 18 in parallel such that the tab 6 is divided into three equal portions. The rear board 3 is formed with triangular tear lines 19, 20 and 21 therein in alignment with the tabs 8, 9, and 10 in a direction of the fold line 26. The respective tear lines 19, 20, and 21 end at cut away portions between the tabs 8, 9, and 10 and which define the tabs 8, 9, and 10, such that the three tabs 8, 9, and 10 are independent.

Figure 2:
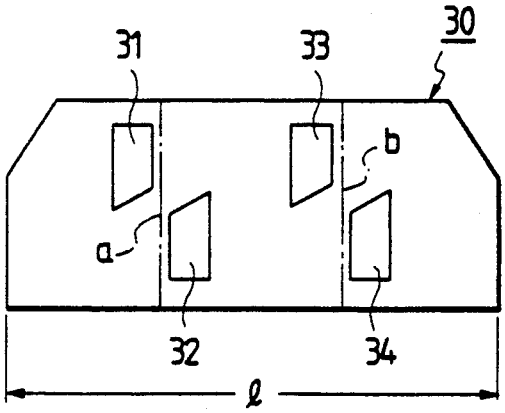
FIG. 2 is a front of a sheet before walls are formed thereon.
Figure 3:
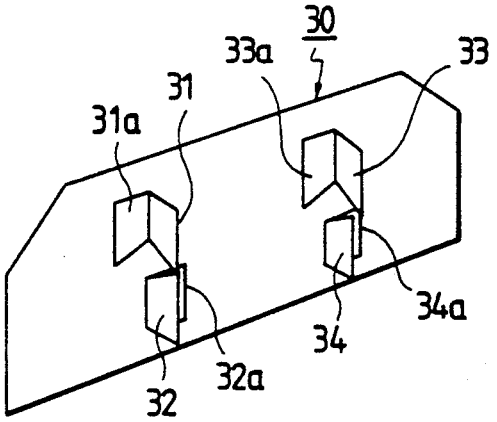
FIG. 3 is a perspective view of the sheet in FIG. 2 showing the walls.

Within the packaging carton 1 of the embodiment is provided a positioning member 30 as shown in FIGS. 2 and 3. The positioning member 30 is formed with walls 31, 32, 33, and 34 therein for holding the magazine container 40 in place within the carton 1. As shown in FIG. 2, the walls 31, 32, 33, and 34 are formed on the both sides of lines a and b that divide the positioning member 30 into three equal portions by cutting rectangular portions such that these portions can be folded in use to form openings 31*a*, 32*a*, 33*a*, and 34*a*.

The positioning member 30 is assembled into the packaging carton 1 such that when the containers 40 are packed, a pair of walls 31 and 32 and a pair of walls 33 and 34 are interposed between the containers 40 accommodated in the packaging carton 1. The length l of the positioning member 30 is slightly smaller than the length L of the packaging carton 1. The positioning member 30 need not be fixed to the carton by means of bonding agent, but can be simply inserted.

Figure 4:
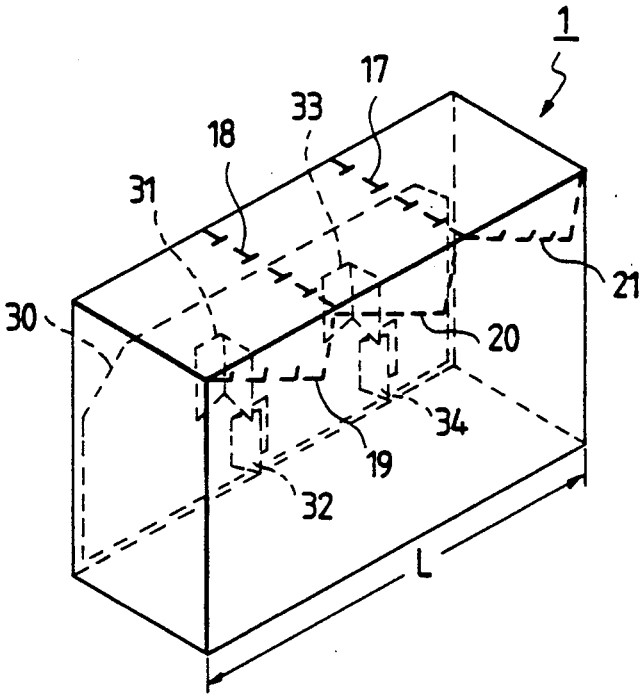
FIG. 4 is a perspective view of the assembled packaging carton.
Figure 5:
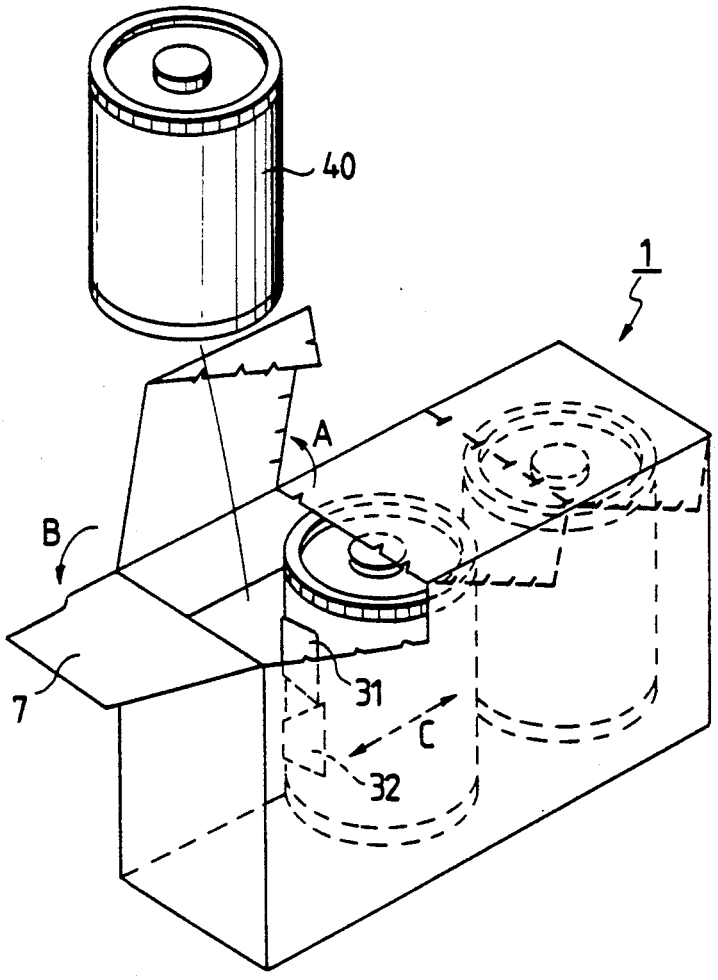
FIG. 5 is a perspective view of the packaging carton which is opened partly.

The positioning member 30 is shown inserted on the side of the front board 5 in FIG. 4 but may also be inserted on the side of the rear board 3.

The procedure and operation for opening the packaging carton 1 will now be described.

The carton is pushed at the tear lines 19 to break the carton, and then the tear lines 19 is pulled up in a direction A. Since the flap 7 is not bonded by adhesive, it can be opened up easily in a direction B without disturbing the opening operation at all. In this manner, one of the magazine containers can be taken out. After the first magazine container has been taken out of the packaging carton, the walls 31 and 32 serve to prevent the displacement of the remaining magazine containers in the lateral direction (arrow C). Thus, the other magazine containers 40 will not be displaced within the carton to drop out through the opening. When subsequent magazine containers are to be removed, their respective tear lines are pushed and pulled in a direction A.

Further, it is evident that the photographic films accommodated in the closed space in the carton are unexposed ones since their respective tear lines have not been opened. As a result, one can distinguish the exposed films from the unexposed films, thereby completely eliminating the possibility of confusion.

While one embodiment has been described, the present invention is not limited to that embodiment. For example, the positioning member 30 may be provided on the sides of both the rear board 3 and the front board 5, or may be of a size that fits to the flap 14 or to the bottom of the carton. The positioning member 30 can be made not only of paper but also of synthetic resin, and may be made in many ways other than that shown in FIGS. 1 and 2.

Moreover, the positioning member 30 may be secured to the carton by an adhesive. Elements similar to the walls 31, 32, 33, and 34 may be formed directly on the carton walls.

While in the described embodiment the packaging carton has been described as accommodating three magazine containers, the present invention may of course be applied to two or more containers.

As described above, the packaging carton according to the present invention is perforated such that the tear lines define opening portions in alignment with a plurality of articles within the packaging carton to allow individual articles to be taken out independently. Further, walls are provided between each article for positioning the articles. This allows only the desired article to be taken out by opening the respective tear lines. Moreover, the respective articles are prevented from moving within the carton. Thus, the present invention overcomes the prior art disadvantages wherein users cannot determine from the magazine appearance whether the films in the container are exposed films or unexposed films.

I claim:

1. A packaging carton of the type including a top, two opposite side boards, and a bottom, and for holding a plurality of articles, said packaging carton comprising:

tear lines in said carton defining openings therein for determining spaces occupied by a plurality of articles, respectively, through which individual articles of said plurality of articles are removed from said packaging carton when said respective tear lines are broken; and wall means projecting into said packaging carton and partitioning the spaces in said carton to maintain said plurality of articles in alignment with each of said openings, respectively;

wherein said wall means comprises separator elements extending perpendicularly from one of said boards between positions occupied by said articles; and wherein said tear lines in said carton comprise first tear lines in said top defining rectangular portions in said top and corresponding to said separator elements and second tear lines in an upper portion of one of said boards acting as a rear board and defining triangular portions which correspond respectively to said rectangular portions.

2. A packaging carton as defined in claim 1, wherein said wall means comprises an interior flat structured element positioned in contact with and parallel to one of said boards in said carton.

3. A packaging carton as defined in claim 2, wherein said element is adhesively applied to said one of said boards in said carton.

4. A packaging carton as defined in claim 2, wherein said separator elements are formed by defining rectangular portions of said element, cutting three sides of each of said rectangular portions, and folding a fourth side of each of said rectangular portions so that said rectangular portions extend perpendicularly from said element between positions occupied by said articles.

5. A packaging carton as defined in claim 2, wherein said element is made of paper.

6. A packaging carton as defined in claim 2, wherein said element is made of a synthetic resin.

7. An unassembled packaging carton for holding a plurality of articles, said unassembled packaging carton comprising:

a front surface having first and second tabs on an upper and lower portion thereof, respectively, said front surface for forming a front side of said carton;

a rear surface having a plurality of first tabs and a second tab on an upper and lower portion thereof, respectively, said rear surface for forming a rear side of said carton; and side surfaces disposed adjacent to said rear surface;

wherein said first tab of said front surface contains tear lines defining openings for determining spaces occupied by said plurality of articles, respectively;

said plurality of first tabs of said rear surface correspond to said tear lines on said first tab of said front surface; and wherein said rear surface contains tear lines on an upper portion thereof corresponding to said tear lines on said first tab of said front surface.

* * * * *